US012221838B1

(12) United States Patent
Copeland

(10) Patent No.: US 12,221,838 B1
(45) Date of Patent: Feb. 11, 2025

(54) MILLING ROD GUIDES AND METHODS

(71) Applicant: Carter D. Copeland, Houston, TX (US)

(72) Inventor: Carter D. Copeland, Houston, TX (US)

( * ) Notice: Subject to any disclaimer, the term of this patent is extended or adjusted under 35 U.S.C. 154(b) by 0 days.

(21) Appl. No.: 18/367,413

(22) Filed: Sep. 12, 2023

(51) Int. Cl.
*E21B 17/10* (2006.01)
*E21B 21/00* (2006.01)
*E21B 37/00* (2006.01)

(52) U.S. Cl.
CPC ..... *E21B 17/1071* (2013.01); *E21B 21/00* (2013.01); *E21B 37/00* (2013.01)

(58) Field of Classification Search
CPC ..... E21B 17/1071; E21B 43/126
See application file for complete search history.

(56) References Cited

U.S. PATENT DOCUMENTS 4,211,625 A * 7/1980 Vandevier ..... C23F 13/02 204/196.05
5,547,020 A * 8/1996 Sable ..... E21B 17/105 166/902
2011/0024370 A1* 2/2011 Ford ..... F04B 47/005 210/512.1
2017/0022768 A1* 1/2017 Sabatier ..... E21B 17/20
2018/0266190 A1* 9/2018 Nielsen, Jr. ..... E21B 17/0426
2021/0102448 A1* 4/2021 Fraser ..... E21B 43/127

OTHER PUBLICATIONS

MIL-DTL-24779; Anodes, Sacrificial, Aluminum Alloy; US Military Specification; US Department of the Navy; 47 pages; Published Jul. 23, 2009.
Black Gold; Black Gold Pump & Supply Inc.; www.blackgoldpump.com; Technical Information Sheet; Signal Hill, CA; 2 pages; Author: Scott Sakakura; Published Aug. 30, 2019.
Alpharod Coupling; Tenaris; Sucker Rod String Coupling; www.tenaris.com; 2 pages; Author: Piccolo Thomas G. Tenaris; Published Sep. 23, 2021.
Alpharod Sucker & Pony Rod; Tenaris; Sucker & Pony Rod; www.tenaris.com; 3 pages; Published Nov. 2, 2017.
Weatherford; Sucker Rod Guides; Weatherford; www.weatherford.com; Houston, TX; 14 pages; Published Nov. 11, 2016.

* cited by examiner

*Primary Examiner* — David Carroll
(74) *Attorney, Agent, or Firm* — bobharter.com; Robert J. Harter

(57) ABSTRACT

Milling rod guide (MRG) systems for oil wells include one or more relatively short rods with hardened milling heads (couplings) and sacrificial anode material located centrally on the body rod body between the milling heads. When driven in a reciprocating motion inside conventional or hardened tubing, the interfaces between the MRGs and the tubing repeatedly crush, grind, and tumble grit into smaller particles. At some smaller size, the solids can then be lifted out of the well with the production. The sacrificial anode section provides cathodic protection of metal surfaces when corrosion inhibitor films are removed. Channels within the anode allow solids to pass through the MRG for further milling or to be produced. MRGs distribute and reduce the radial and shear stresses at the interfaces of the of the rod string and the tubing in vertical, deviated, inclined, or horizontal sections of the pumping system, thereby mitigating wear.

18 Claims, 8 Drawing Sheets

MILLING ROD GUIDES AND METHODS

FIELD OF THE DISCLOSURE

This patent generally pertains to oil wells with sucker rods and tubing and more specifically pertains to means for disintegrating sludge and flushing the resulting grit up out of the well while mitigating corrosion and wear of tubing and rod strings.

BACKGROUND

Oil wells are vital components of the petroleum industry, allowing for the extraction of crude oil from deep beneath the Earth's surface. The process involves a combination of sophisticated machinery and engineering techniques. One of the most common methods used in onshore oil production involves the use of a pumpjack, which operates on the principle of reciprocating motion.

The pumpjack is a large mechanical device situated above the wellhead. It consists of a beam supported by an A-frame structure, with a counterweight on one end and a pump assembly on the other. The pumpjack is powered by a motor or an engine, which drives the beam up and down in a continuous pumping motion. This movement creates the necessary force to bring the oil to the surface.

At the bottom of the well, there is a submerged downhole pump, also known as a sucker rod pump or a nodding donkey pump. This pump is a positive displacement device that utilizes a piston-like mechanism to lift the oil.

The pump is connected to the pumpjack by a rod string, which is a series of long, slender rods (sucker rods) interconnected by internally threaded rod couplings (rod boxes). The motion of the pumpjack is transmitted through rod string to the downhole pump, causing it to move up and down within the wellbore.

To ensure the efficiency and safety of the oil well, tubing and casing are essential components. Casing is a series of steel pipes that are cemented into the wellbore after the hole is drilled to provide structural integrity, prevent the collapse of the surrounding rock formation, and isolate the various strata of formations. After the casing is set, selective zones are opened with various completion techniques to allow specific formations to flow to into casing.

Inside the casing, there is a tubing string, which is a series of smaller diameter pipes interconnected by internally threaded couplings. The tubing string runs from the surface down to the production zone. The tubing provides a conduit for oil and gas to flow to the surface. Once the formation ceases to flow to the surface, a downhole pump is run inside the tubing to artificially lift the fluids from the formation through the tubing to the surface.

As the pumpjack operates, the reciprocating motion of the beam causes the sucker rods to push and pull the downhole pump. During the downstroke, the pump cavity between two valves reaches extreme pressures and forces the fluid into the tubing above the pump. On the upstroke, one of the valves closes and the pump pushes the fluids upward through the tubing, eventually reaching the surface. During the upstroke, formation pressure refills the cavity of the pump for the process to be repeated. The reciprocating motion of the pump can be repeated thousands of times per day.

The relative motion between the rods and the tubing creates a multitude of contact points between the rods string and the tubing. The forces and stresses at each of these points of contact vary based on the configuration of the pumping system, the operating practices, the degree of inclination at any point in the well from the original drilling operations, and the solids that are entrained in the produced fluids. The current industry practice typically uses combinations of steel in the rods, the rod couplings, and the tubing where at least one of the components is softer than the grit in the production. The current industry practices do not provide an alternative method to instantaneously protect the steel surfaces from corroding when the corrosion inhibitor is scraped off the steel surfaces.

Upon reaching the surface, the oil is collected in a storage tank, while the associated natural gas is separated and often sent for further processing. Advanced sensors and control systems are employed to monitor the well's performance, ensuring optimal oil production rates and identifying any potential issues that may require attention.

DETAILED DESCRIPTION

FIGS. 1-15 illustrate example milling rod guides 10 (e.g., milling rod guides 10*a* and 10*b*), milling rod guide systems 12, and related methods that may prolong the life of a well 14 and allow it to operate more efficiently. The well 14 can be used for drawing a production fluid 16 up from an underground source to the Earth's surface. Some examples of the production fluid 16 include oil, gas, water, and mixtures thereof, etc.

Figure 1:
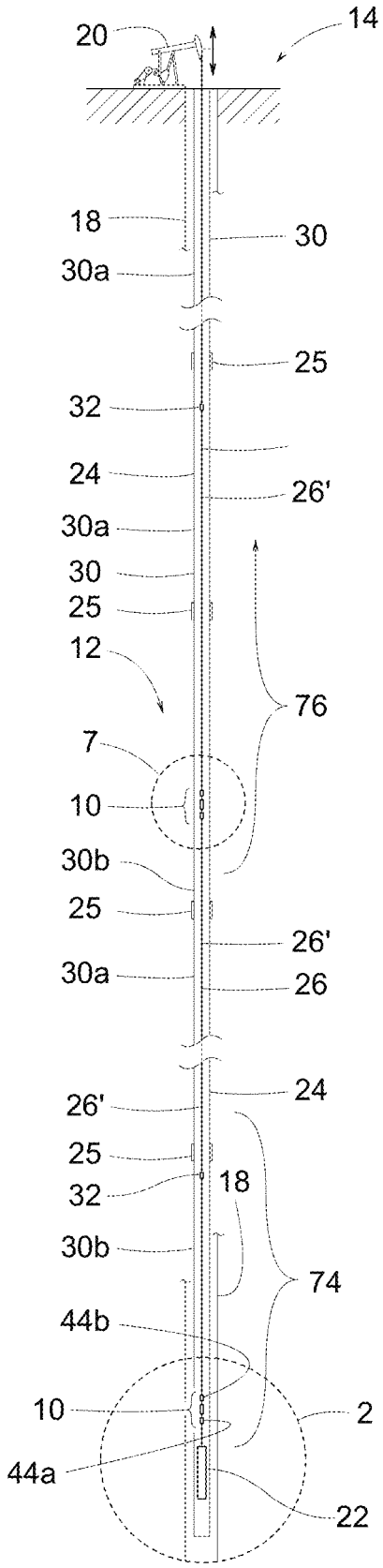
FIG. 1 is a cross-sectional view of an example well that includes a milling rod guide system constructed in accordance with the teachings disclosed herein.
Figure 2:
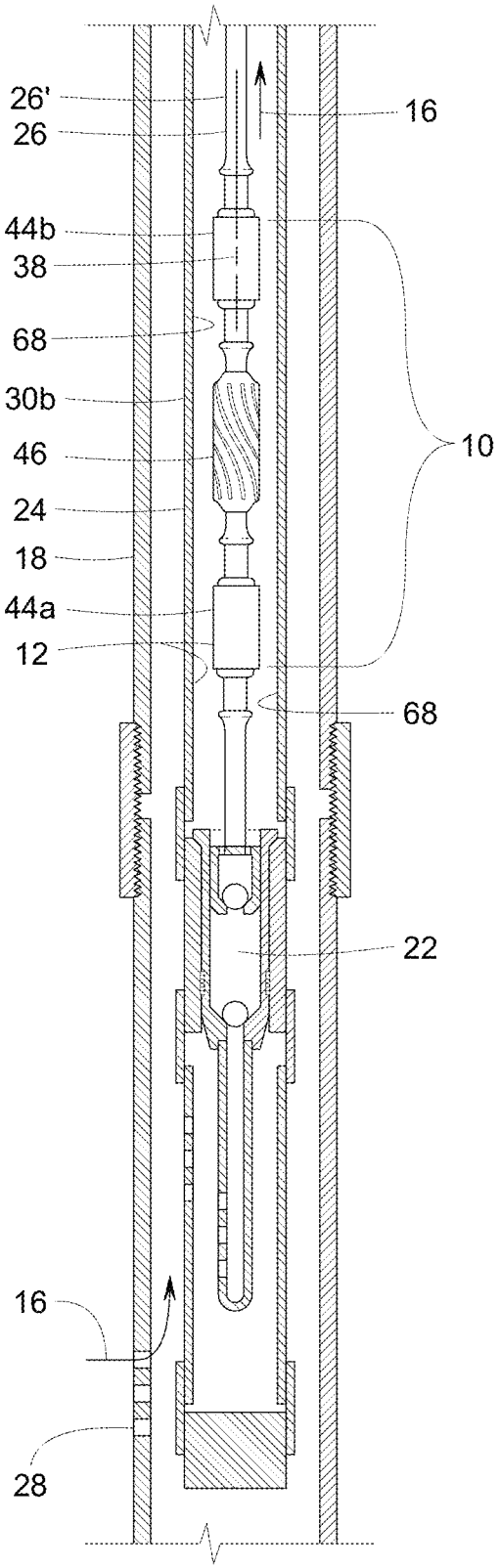
FIG. 2 is an enlarged view of section-2 in FIG. 1.

In the examples illustrated in FIGS. 1 and 2, some main parts of the well 14 include a casing 18, a pumpjack 20, a downhole pump 22, a tubing string 24, and a rod string 26. The casing 18 provides the well 14 with a rigid outer wall. Perorations 28 in the casing 18 allow the production fluid 16 from the underground source to enter the well 14.

The tubing string 24 extends down through the casing 18 and supports the pump 22 near the bottom of the well 14. The tubing string 24 provides a conduit for conveying the production fluid 16 up through the well 14. Some examples of the tubing string 24 comprise a plurality of tubing sections 30 interconnected by a plurality of threaded tube couplings 25. In some examples, the plurality of tubing sections 30 includes one or more main tubing sections 30*a* and/or one or more hardened tubing sections 30*b*. The hardened tubing sections 30*b* have a greater surface hardness than the more conventional main tubing sections 30*a*.

The rod string 26 connects the pumpjack 20 to the downhole pump 22. The pumpjack 20 actuates the pump 22 by moving the rod string 26 cyclically up and down within the generally stationary tubing string 24. The pump 20 draws the production fluid 16 from underground and forces the fluid 16 up through the tubing string 24 to the surface. The motion of the rod string 26 creates a complex pattern of wear and friction between the tubing string and the rod string.

With further reference to FIGS. 3-6, some examples of the rod string 26 comprise a plurality of sucker rods 26' interconnected by a plurality of rod boxes 32. Some examples of rod boxes 32 are internally threaded at each end to screw onto and couple two sucker rods 26'. Other examples of rod boxes 32 have one end threaded to screw onto a first sucker rod 26' with an opposite end that is an integral part of a second sucker rod 26', whereby the first sucker rod 26' screws into the rod box 32 of the second sucker rod 26' with the integral rod box.

Figure 7:
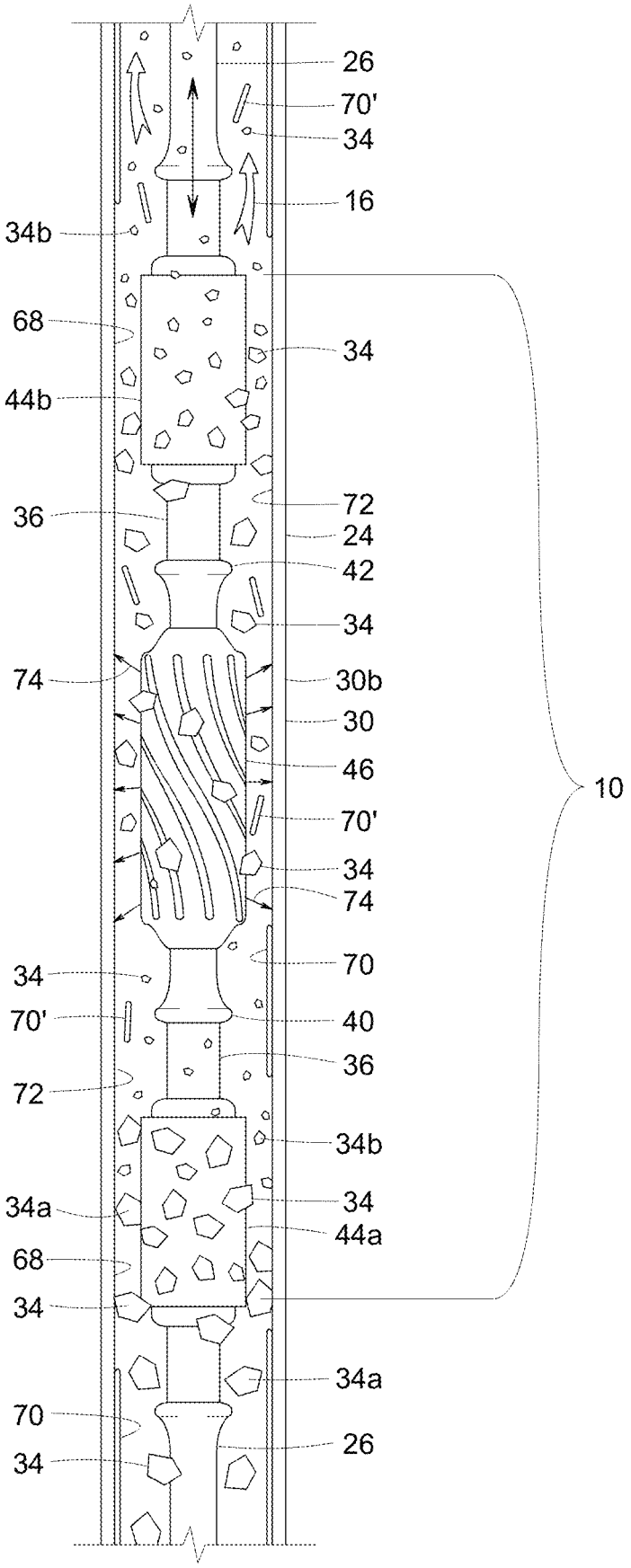
FIG. 7 is an enlarged view of section-7 in FIG. 1.

Since the production fluid 16 comes from the ground, the fluid 16 is often contaminated with grit 34, as shown in FIG. 7. If the grit 34 is relatively heavy and of large particle size, the grit 34 tends to sink and accumulate near the bottom of the well 14, e.g., near the downhole pump 22. The grit 34 can be in the form of sludge of various consistencies. The sludge can be different mixtures and concentrations of sand, loose scale, limestone, calcium carbonate, iron sulfide and various other solid particulate. Some of these solids may come from scale that is formed inside the tubing.

Figure 6:
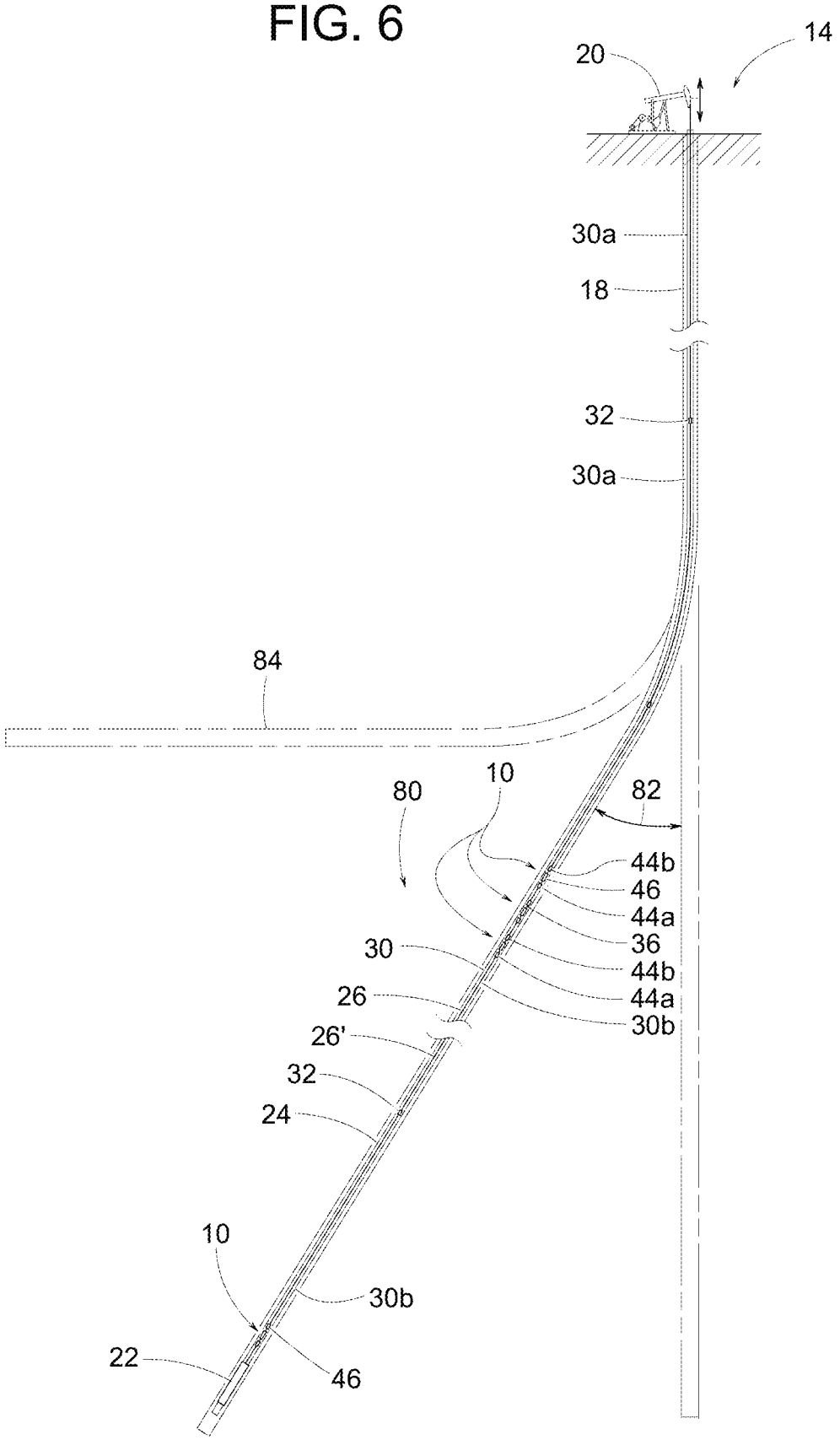
FIG. 6 is a cross-sectional view of an example deviated well that includes a milling rod guide system constructed in accordance with the teachings disclosed herein.

The milling rod guide system 12, which includes the milling rod guide 10, helps disintegrate the sludge and reduce the grit particle size. The flow of production fluid 16 can carry the fine lighter grit 34 away from the downhole pump 22 and up through the tubing string 24 to where the production fluid 16 with entrained grit 34 eventually exits the well 14. The milling rod guide 10 can be installed near the downhole pump 22 and/or wherever grit 34 might tend to accumulate or create problems. In some examples, one or more milling rod guides 10 are installed partway up the well 14 or at an intermediate location along the length of a horizontal or otherwise deviated well 14 (FIG. 6). When installed at an inclined or horizontal location, the milling rod guides 10 help support the weight of the rod string 26 in a radial direction within the tubing string 24.

Figure 8:
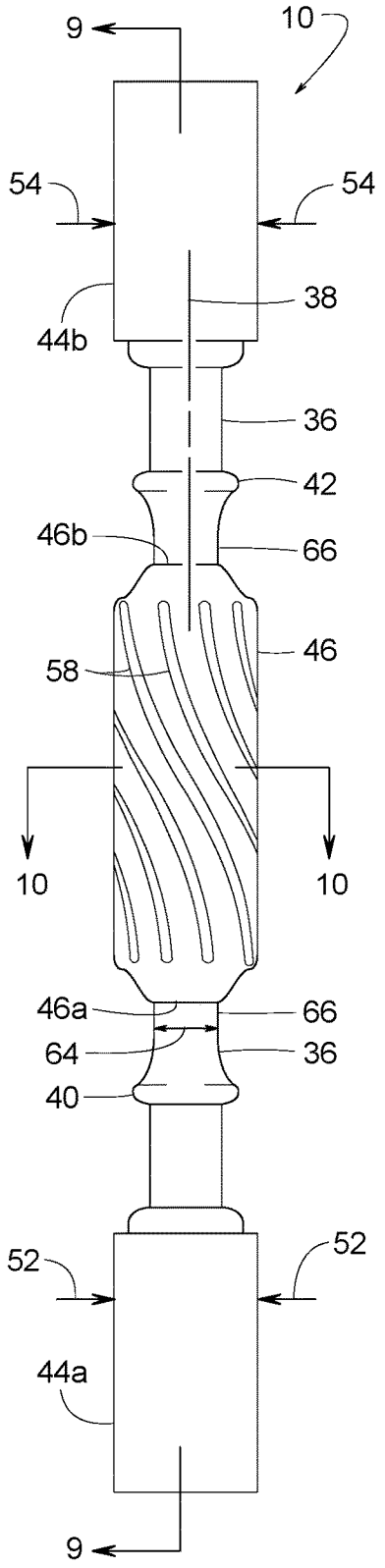
FIG. 8 is a front view of an example milling rod guide used in the examples shown in FIGS. 1-7.
Figure 9:
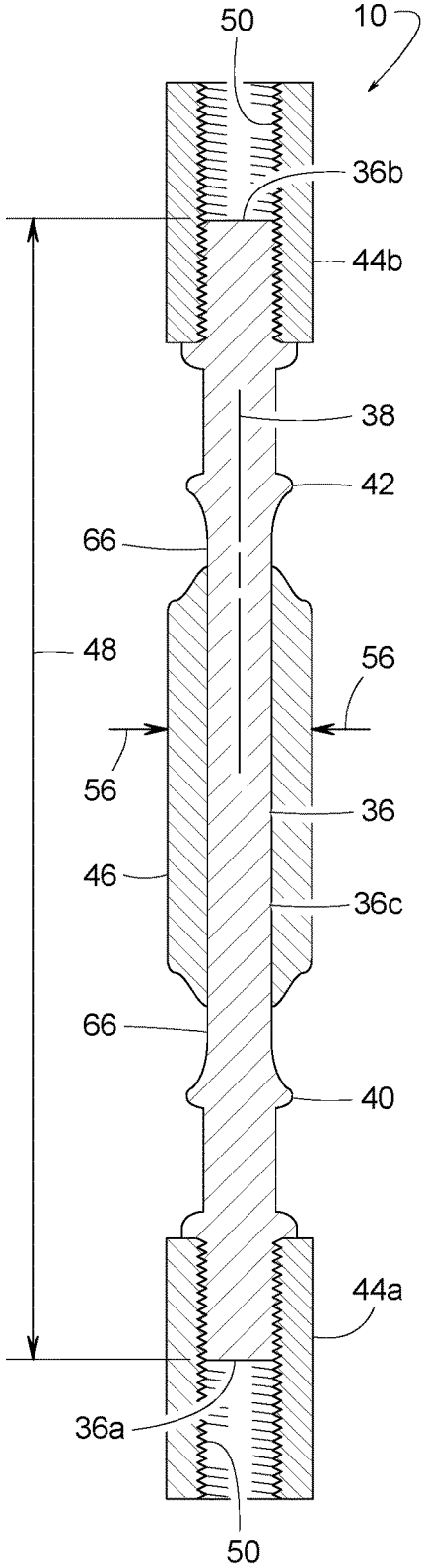
FIG. 9 is a cross-sectional view taken along line 9-9 of FIG. 8.
Figure 10:
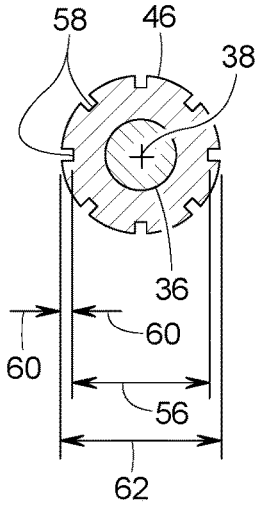
FIG. 10 is a cross-sectional view taken along line 10-10 of FIG. 8.

Referring to FIGS. 8-10, some examples of milling rod guide 10 comprise an elongate rod 36 with a longitudinal axis 38, a first shoulder 40 on the rod 36, a second shoulder 42 on the rod 36, a first milling head 44*a*, a second milling head 44*b*, and a sacrificial anode 46 between the two milling heads 44*a* and 44*b*. In some examples, the rod 36 is made of steel for strength and durability. The rod 36 has a first rod end 36*a*, a second rod end 36*b*, and a central section 36*c* between the first and second rod ends 36*a* and 36*b*. The rod 36 has an overall length 48 as measured along its longitudinal axis 38. In some examples, the first and second shoulders 40 and 42 are an integral part of the rod 36 and provide structure to hang the rod 36 and any connected rod string 26 from a known elevator tool used for installing and removing a rod string. In some examples, the first and second shoulders 40 and 42 are an integral part (e.g., an axial face) of the first and second milling heads 44*a* and 44*b*.

In some examples, the first and second milling heads 44*a* and 44*b* have internal threads 50 for screwing onto the rod's first and second rod ends 36*a* and 36*b*, respectively. The first and second milling heads 44*a* and 44*b* respectively have a first head outer diameter 52 and a second head outer diameter 54.

In some examples, each of the first and second head outer diameters 52 and 54 have a surface hardness of at least 60 Rc (Rockwell Scale-C) for crushing and grinding common examples of grit 34. In some examples, the milling heads 44*a* and 44*b* have a surface hardness exceeding 69 Rc for crushing and grinding particularly hard examples of grit 34, such as sand and iron sulfide.

Some example means for hardening the surface of the milling heads 44*a* and 44*b* include boriding (boronizing), coating with DLC (diamond-like carbon), sprayed metal coating (e.g., Class-SM spray metal), and various combinations thereof. In some examples, each of the milling heads 44*a* and 44*b* are a Class-SM coupling with an overcoat of DLC. In some examples, providing milling heads 44*a* and 44*b* with a surface hardness exceeding 69 Rc is achieved by known boriding methods of treating steel.

In some examples, milling heads 44*a* and 44*b* provide a dual purpose of serving as means for milling grit 34 and means for coupling a milling rod guide 10 to a sucker rod 26' or another milling rod guide 10. In some examples a first milling head 44*a* is shared by two adjoining milling rod guides 10. Running more milling rod guides 10 creates more milling points of contact with the tubing 24.

The sacrificial anode 46, in some examples, is a generally cylindrical mass with an anode outermost diameter 56. In some examples, the anode outermost diameter 56 is substantially equal to the first and second head outer diameters 52 and 54, which provides a maximum amount sacrificial anode material without obstructing the flow of production fluid 16 past the milling rod guide 10. The term, "substantially equal," means that the anode outermost diameter 56 is within twenty percent of the first and second head outer diameters 52 and 54. So, for example, if the first and second head outer diameters 52 and 54 are 1.0 inch, then the anode outermost diameter 56 is 0.8 to 1.2 inches. In some examples, the first and second head outer diameters 52 and 54 are 1.7 inches, and the anode outermost diameter 56 is 1.36 to 2.04 inches.

In some examples, the sacrificial anode 46 defines a plurality of grooves 58 running lengthwise between a first end 46*a* and a second end 46*b* of the sacrificial anode 46. The plurality of grooves 58 have a radial depth 60 that defines an anode minor diameter 62 that is greater than a throat outer diameter 64 of a throat area 66 extending axially between the sacrificial anode 46 and shoulders 40 and 42. The grooves 58 of such length and depth provide a pathway for production fluid 16 to flow past the milling rod guide 10. In some examples, the grooves 58 curve (e.g., helical) about the longitudinal axis 38. The grooves 58 being curved, rather than straight, create a pathway for grit 34 around the circumference of the anode 46 to help prevent the sacrificial anode 46 from wearing a groove or slot into the sidewall of the tubing 30.

The sacrificial anode 46 is sized and positioned to create one throat area 66 between the first shoulder 40 and the sacrificial anode 46 and another throat area 66 between the second shoulder 42 and the sacrificial anode 46. In some examples, each throat area 66 has a throat outer diameter 64 that is less than the anode outermost diameter 56. The throat areas 66 provide clearance for a known elevator tool to grab the rod 36 during installation or removal of a tubing string 24.

In some examples, the milling rod guide 10 is relatively short with a slenderness ratio of less than 40, wherein the slenderness ratio is defined as the rod's overall length 48 divided by the anode outermost diameter 56. The term, "relatively short," means that the milling rod guide 10 is shorter than most of the sucker rods 26' in the same rod string 26. With milling rod guide 10 being relatively short with a slenderness ratio of less than 40, it is less likely that the rod's central section 36*c* will adversely scrape against any tubing sections 30. Further, the milling heads 44*a* and 44*b* can more easily protect the anode 46 of the milling rod guide 10 from excessive flexure.

In some examples, the sacrificial anode 46 is softer than the surface hardness of the milling heads 44*a* and 44*b*. Until the anode 46 section wears down to the diameter of the milling heads 40*a* and 40*b*, the anode 46 acts as a rod guide with passive galvanic protection. Grinding and milling action is minimal during this phase of the usage. When the anode diameter reaches the diameter of the milling heads 40*a* and 40*b*, grinding and crushing of the grit 34 begins at the milling heads 40*a* and 40*b*. The remaining anode material no longer interferes with milling operations while the maximum contact area of the anode 46 with the tubing 30 is achieved. The sacrificial anode 46 is attached in intimate contact with the rod's central section 36*c* to help protect the rod 36 and the nearby surrounding tubing string 24 from galvanic corrosion.

The term, "sacrificial anode" refers to any metal material that is less noble than iron. Some example materials of the sacrificial anode 46 include aluminum, magnesium, zinc, and various alloys thereof. Although some examples of the sacrificial anode 46 are made of pure aluminum, oxides tend to build up on pure aluminum, and oxides can inhibit cathodic protection. To minimize oxidation, some examples of sacrificial anode 46 are comprised of an aluminum alloy, wherein only most of the alloy consists of aluminum by weight. Some example aluminum alloys have a portion of indium, wherein the indium makes up 0.014 to 0.200 percent by weight of the aluminum alloy. Some example aluminum alloys have a portion of gallium, wherein the gallium makes up 0.092 to 0.110 percent by weight of the aluminum alloy. Such proportions have been found to be effective and fall within a US military specification known as MIL-DTL-24779.

As shown in FIG. 7, the milling rod guide 10 works in conjunction with an adjacent surrounding tubing section 30 to produce the milling rod guide system 12. As the pumpjack 20 moves the rod string 26 up and down, the milling rod guide 10 crushes and grinds the grit 34 between the heads of the milling rod guide 10 and the tubing 30. The preferred method is to use milling rod guides 10 in tubing sections 30*b* that are hardened rather than made of more conventional steel such as main tubing sections 30*a*. So, in some examples, the grit 34 is milled between a hardened inner surface 68 (e.g., first inner surface) of a hardened tubing section 30*b* and each of the hardened milling heads 44*a* and 44*b*. When both surfaces are harder than the grit 34, the crushing action is maximized. In other examples, the grit 34 is crushed and ground between more conventional tubing (main tubing sections 30*a*) and the hardened milling heads 44*a* and 44*b*. The milling process of crushing and grinding pulverizes the grit 34, thereby reducing the grit 34 from a larger particle size 34a to a smaller particle size 34b. The terms, "larger particle size" and "smaller particle size" are relative to each other. So, for example, grit of a larger particle size is simply larger than grit of a smaller particle size. The size of the pulverized grit 34 is reduced until the properties of the fluid 16 and the velocity of the fluid 16 can lift and produce the grit 34 out of the wellbore.

In some examples, the milling rod guide 10 scrapes corrosion inhibitor film 70 off the inner surface 68 of the tubing 30. When this happens, the flow of production fluid 16 carries away the scraped-off physical barrier film (film 70'), leaving exposed metal (bare sections 72) to be attacked and corroded by the fluids 16. Until additional inhibitor is applied, the sacrificial anode 46 provides an alternative method of protection for the exposed metal. The metal loss from the galvanic cell comes from the anode material rather than the exposed steel. The term, "corrosion inhibitor film" refers to any material coating that acts as a physical barrier between metal surfaces. Galvanic protection refers to an electrolytic protection between exposed metal surfaces that preferentially allows metal ions to be lost from sacrificial material rather than from the metal being protected. In some examples, the corrosion inhibitor film 70 is a solid. In some examples, the corrosion inhibitor film 70 is a non-solid. In some examples, the scraped-off film 70' is in the form of flakes or specks. In some examples, the scraped-off film 70' is in the form non-solid substance. Various corrosion inhibitors are well known to those of ordinary skill in the art.

In some examples, the inner surface of the conventional tubing (main tubing section 30*a*) or hardened tubing section 30*b* is harder than the sacrificial anode 46. The sacrificial anode surface will wear until the diameter of the anode is the diameter of the hardened milling heads 44*a* and 44*b* of the milling rod guide 10. In some examples, the inner surface 68 of the tubing section 30*b* is harder than rod 36, as it is important that the rod 36 be rugged and not brittle.

In some examples, the hardened inner surface 68 is more noble than the rod 36, and the rod 36 is more noble than the sacrificial anode 46. This allows the sacrificial anode 46 to cathodically protect both the rod 36 and the tubing 24.

In the example shown in FIG. 1, the well 14 is generally straight and vertical with the rod string 26 comprising multiple sucker rods 26'. The sucker rods 26' and the rod boxes 32 can have increased contact with the tubing string 26 in sections of the well 14 where there are minor deviations or in areas where there is buckling of the rod string 26. Single or multiple milling rod guides 10 can be deployed at various locations in the rod string 26 depending on a variety of factors. In some examples, a first milling rod guide 10 with a first milling head 44*a* on a first rod 36 is disposed within a first area 74 of the well 14, wherein the first area 74 is within five hundred feet of the downhole pump 22. In some examples, a second milling rod guide 10 with a second milling head 44*b* on a second rod 36 is disposed within a second area 76 of the well 14, wherein the second area 76 is more than five hundred feet from the downhole pump 22. In some examples, the second milling rod guide 10 is spaced apart from the first milling rod guide 10 by a plurality of sucker rods 26' of the rod string 26, wherein each sucker rod 26' of the plurality of sucker rods 26 is longer than each of the first milling rod guide 10 and the second milling rod guide 10. Such an arrangement might address some issues. For example, in some cases, a greater concentration of the grit 34 might exist in the first area 74 of the well 14. In cases where the well 14 might be deviated in the second area 76, the tubing string 24 and rod string 26 might benefit from the second milling rod guide 10 providing more radial support in the second area 76.

Figure 3:
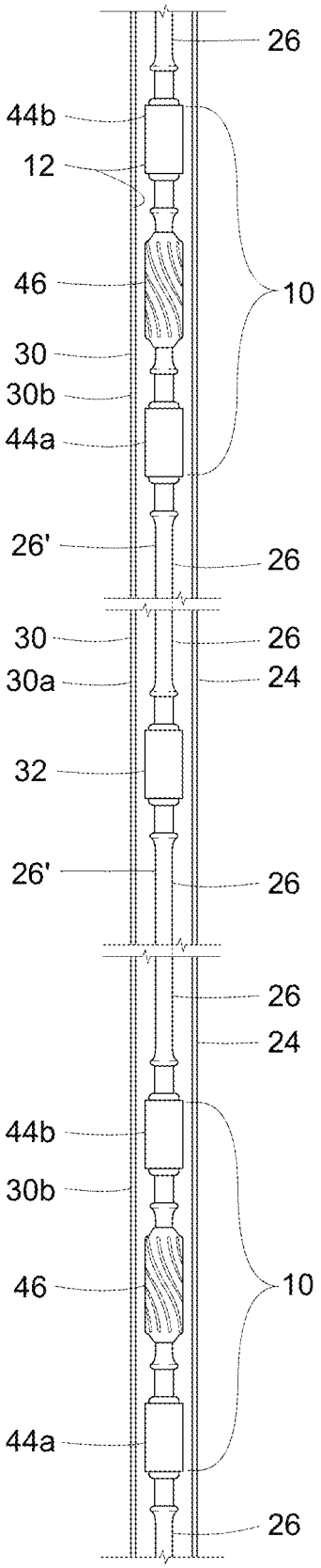
FIG. 3 is a cross-sectional view of an example well that includes a milling rod guide system constructed in accordance with the teachings disclosed herein.
Figure 4:
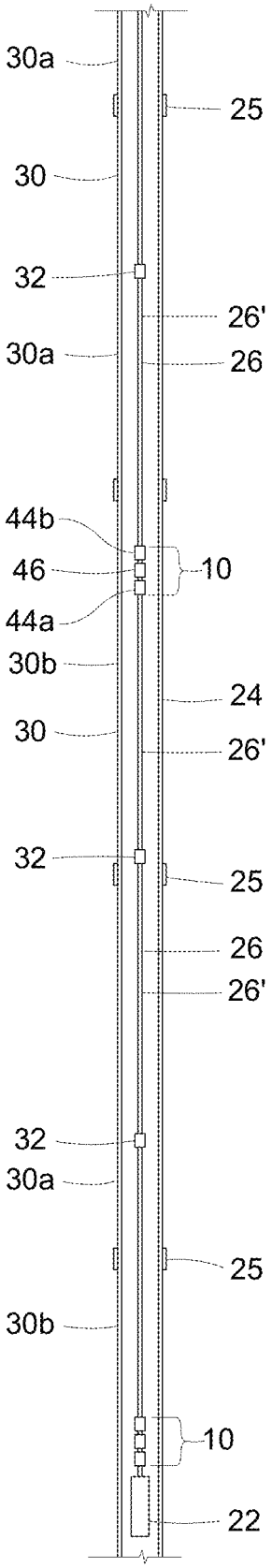
FIG. 4 is a cross-sectional view of another example well that includes a milling rod guide system constructed in accordance with the teachings disclosed herein.

Still referring to FIG. 1, the second milling rod guide 10 is interposed between two sucker rods 26', both of which are at least twice as long as the second milling rod guide 10. The sucker rods 26' are relatively long to speed assembly and disassembly of the rod string 26. The second milling rod guide 10 is relatively short to provide concentrated crushing and grinding in a localized area of the well 14. FIG. 1 also show multiple sucker rods 26' interposed between the first and second milling rod guides 10, thereby providing greater spacing between multiple milling rod guides 10, and thus providing greater concentrated crushing and grinding in localized areas of the well 14. FIGS. 3 and 4 show other examples of multiple sucker rods 26' interposed between multiple milling rod guides 10.

Figure 5:
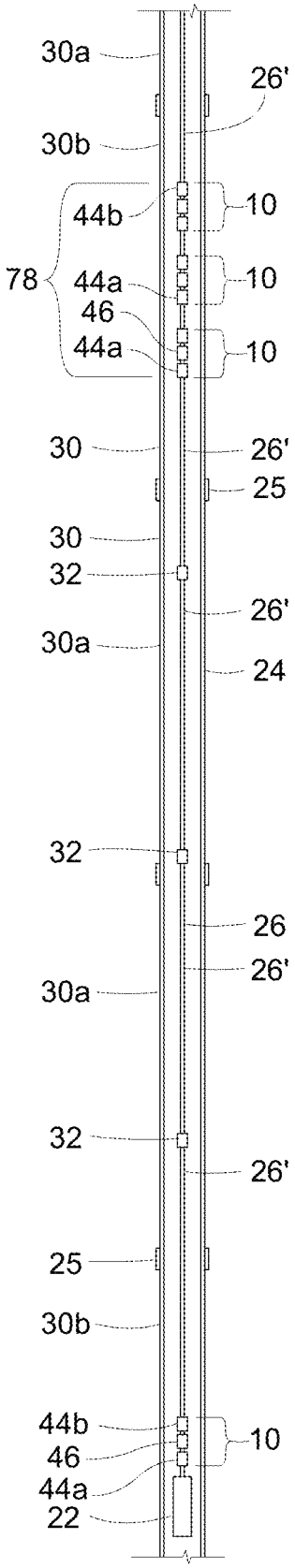
FIG. 5 is a cross-sectional view of yet another example well that includes a milling rod guide system constructed in accordance with the teachings disclosed herein.

FIG. 5 shows multiple milling rod guides 10 interconnected in an end-to-end arrangement 78, and the end-to-end arrangement 78 is interposed between two sucker rods 26'. The end-to-end arrangement 78 of multiple milling rod guides 10 broadens the localized area of grit milling in some desired applications.

The well configuration shown in FIG. 6 is similar to that of FIG. 1. In FIG. 6, however, the well 14 deviates from vertical. In one section 80 of the well 14, the tubing section 30 and one or more milling rod guides 10 (and their corresponding rods 36) are at an incline that deviates more than thirty degrees from vertical, as indicated by angle 82. In some examples, the tubing section 30 and one or more milling rod guides 10 (and their corresponding rods 36) can be generally horizontal, as indicated by phantom line 84. With a deviated well, as shown in FIG. 6, the milling rod guide 10 can be particularly useful in guiding the rod string 26 along the inner surface 68 of the tubing string 24.

In examples where the tubing string 24 includes both hardened tubing sections 30*b* and more conventional main tubing sections 30*a*, the hardened tubing sections 30*b* are arranged such that the plurality of milling rod guides 10 (e.g., series of milling rod guides 10) are adjacent to the plurality of hardened tubing sections 30*b*, and the plurality of sucker rods 26' are adjacent to the plurality of main tubing sections 30*a*. In the examples shown in FIGS. 1-6, at least some of the plurality of main tubing sections 30*a* are interposed between two hardened tubing sections 30*b*, and at least some of the plurality of hardened tubing sections 30*b* are interposed between two main tubing sections 30*a*.

Figure 11:
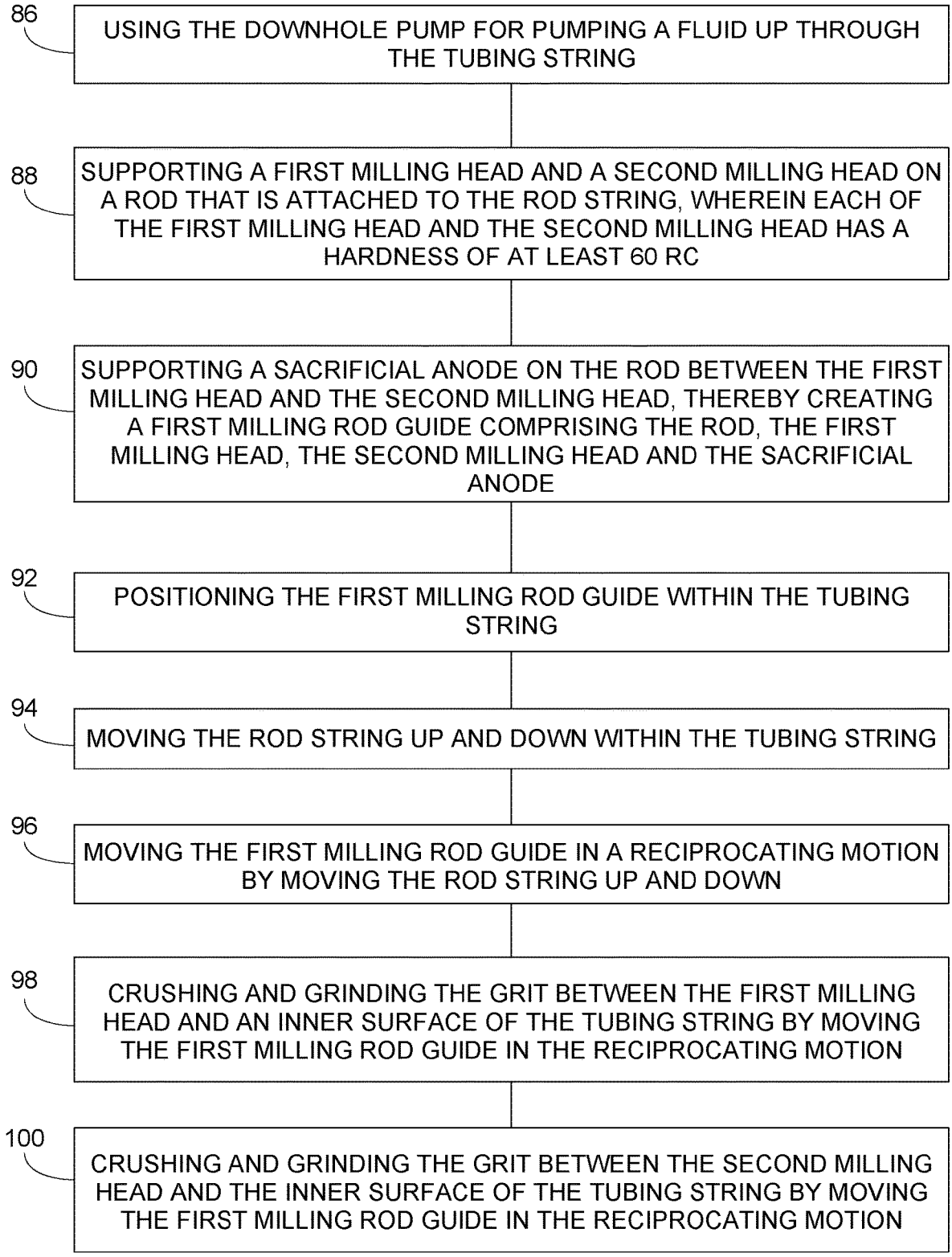
FIG. 11 is a flow diagram showing example method steps of the milling rod guide method taught herein.
Figure 12:
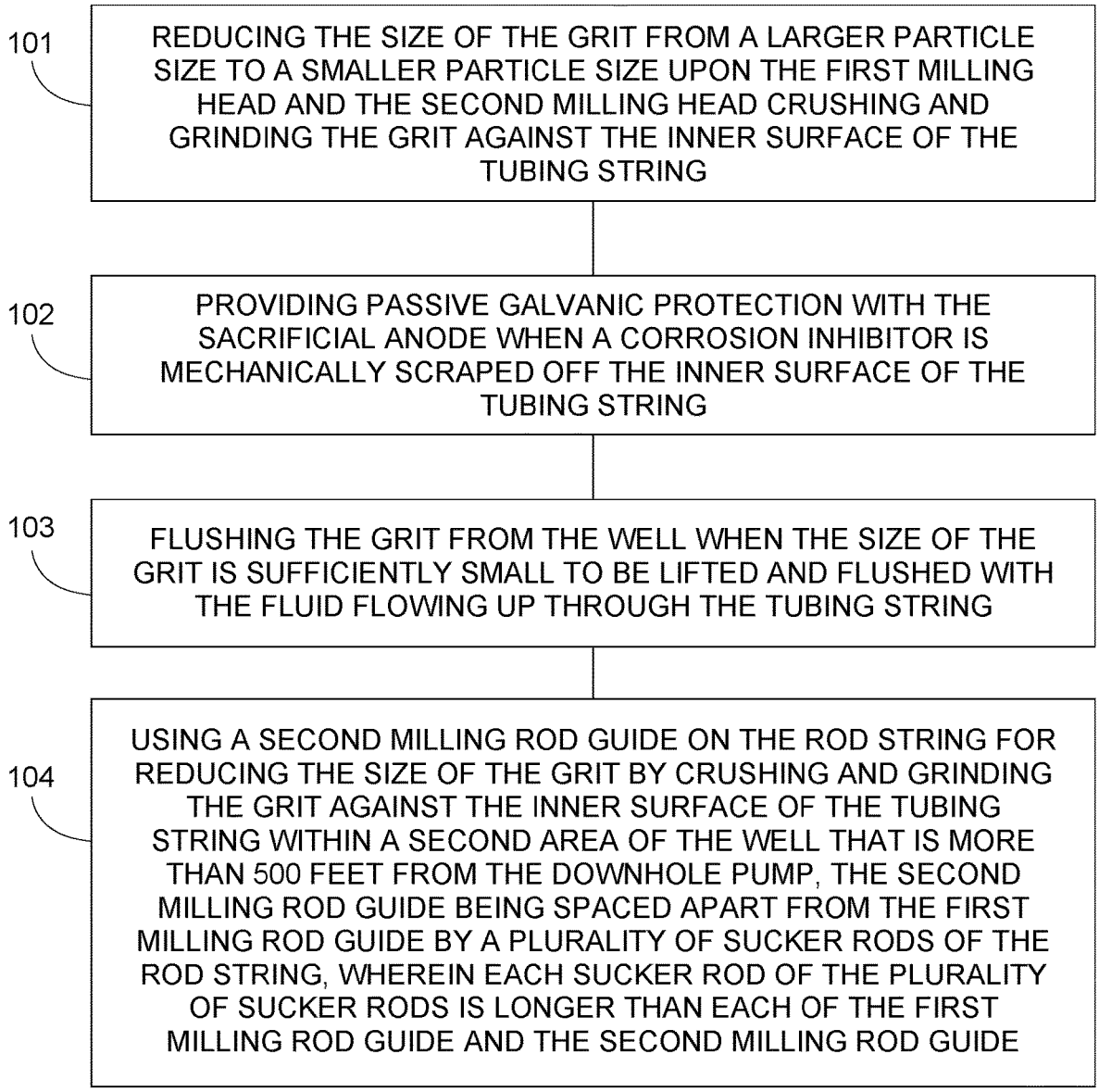
FIG. 12 is a flow diagram showing additional method steps of the milling rod guide method taught herein.

FIGS. 11 and 12 illustrate methods steps associated with the milling rod guide system 12. In some examples, the milling rod guide method involves crushing and grinding grit 34 in a well 14 that contains the tubing string 24 and the rod string 26 attached to the downhole pomp 22.

A box 86 in FIG. 11 represents using the downhole pump 22 for pumping the fluid 16 up through the tubing string 24. A box 88 represents supporting the first milling bead 44*a* and the second milling head 44*b* on the rod 36 that is attached to the rod string 26, wherein each of the first milling head 44*a* and the second milling head 44*b* has a hardness of at least 60 Rc. A box 90 represents supporting the sacrificial anode 46 on the rod 36 between the first milling head 44*a* and the second milling head 44*b*, thereby creating a first milling rod guide 10 comprising the rod 36, the first milling bead 44*a*, the second milling head 44*b* and the sacrificial anode 46. A box 92 represents positioning the first milling rod guide 10 within the tubing string 24. A box 94 represents moving the rod string 26 up and down within the tubing string 24. A box 96 represents the first milling rod guide 10 in a reciprocating motion by moving the rod string 26 up and down. A box 98 represents crushing and grinding the grit 34 between the first milling head 44*a* and an inner surface (e.g., inner surface 68 of the tubing string 24 by moving the first milling rod guide 10 in the reciprocating motion. A box 100 represents crashing and grinding the grit 34 between the second milling head 44*b* and the inner surface of the tubing string 24 by moving the first milling rod guide 10 in the reciprocating motion.

A box 101 in FIG. 12 represents reducing the size of the grit 34 from a larger particle size to a smaller particle size upon the first milling head 44*a* and the second milling head 44*b* crushing and grinding the grit 34 against the inner surface of the tubing string 24. A box 102 represents providing passive galvanic protection with the sacrificial anode 46 when a corrosion inhibitor 70 is mechanically scraped off the inner surface of the tubing string 24. A box 103 represents flushing the grit 34 from the well 14 when the size of the grit 34 is sufficiently small to be lifted and flushed with the Dud 16 flowing ap through the tubing string 24. A box 104 represents using a second milling rod guide 10 on the rod string 24 for reducing the size of the grit 34 by crushing and grinding the grit 34 against the inner surface of the tubing string 24 within a second area 76 of the well 14 that is more than 500 feet from the downhole pump 22, wherein the second milling rod guide 10 is spaced apart from the first milling rod guide 10 by a plurality of sucker rods 26' of the rod string 26, and each socket rod 26' of the plurality of sucker rods 26' is longer than each of the first milling rod guide 10 and the second milling rod guide 10.

Figure 13:
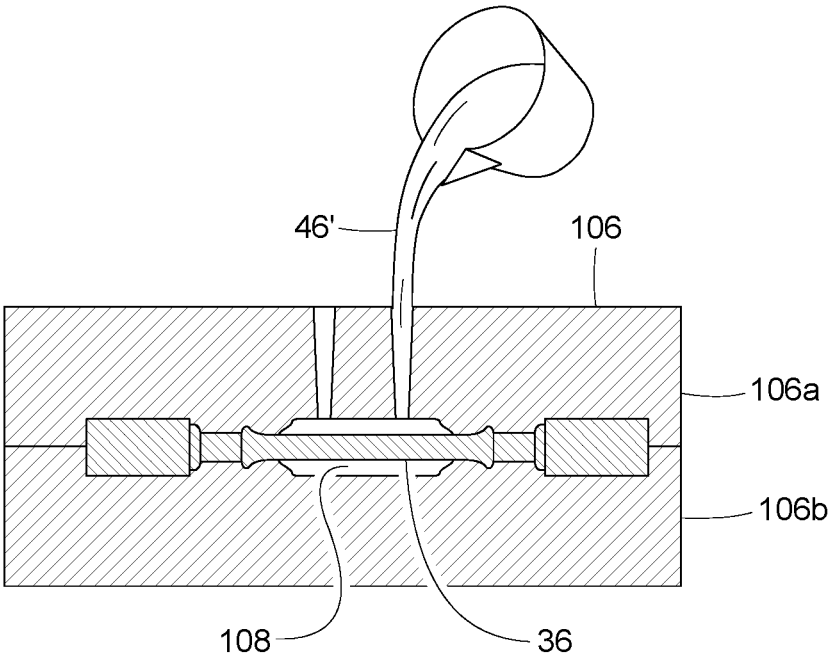
FIGS. 13-15 are schematic diagrams illustrating example method steps for making an example milling rod guide constructed in accordance with the teachings disclosed herein.
Figure 14:
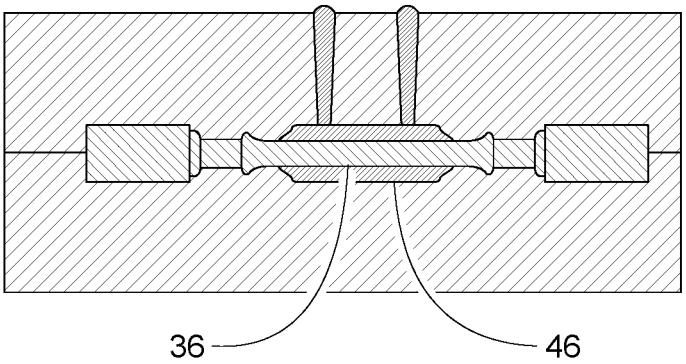
Figure 15:
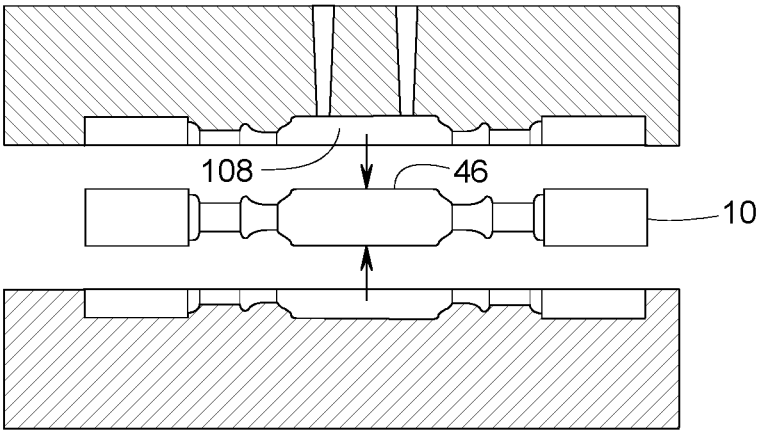

FIGS. 13-15 illustrate one example means for attaching the sacrificial anode 46 to a rod 36. In this example, the sacrificial anode 46 is cast onto the rod 36 in a mold 106. FIG. 13 shows the rod 36 inserted in two halves 106*a* and 106*b* of the mold 106 and molten sacrificial anode material 46' being poured into a mold cavity 108. FIG. 14 shows the sacrificial anode 46 solidifying around the rod 36 in the mold 106. FIG. 15 shows removing the rod 36 with the attached sacrificial anode 46 from within the mold 106. In some examples, the mold 106 is a hinged book mold, wherein the two halves 106*a* and 106*b* are pivotally hinged to each other, so the mold 106 can pivot open and closed. It should be clear to those of ordinary skill in the art that the sprue and riser of the mold 106 is placed at the mold parting line for ease of their removal once the casting is removed from the mold 106.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The invention claimed is:

1. A milling rod guide system for use in a well comprising:

a rod being elongate to define a longitudinal axis, the rod having a first rod end, a second rod end, and a central section between the first rod end and the second rod end; the rod having an overall length as measured along the longitudinal axis;

a first shoulder on the rod, the first shoulder encircling the longitudinal axis, the first shoulder being between the first rod end and the central section;

a second shoulder on the rod, the second shoulder encircling the longitudinal axis, the second shoulder being between the second rod end and the central section;

a first milling head on the first rod end of the rod, the first milling head having a first head outer diameter, the first milling head having a surface hardness of at least 60 Rc at the first head outer diameter, the surface hardness of the first milling head being harder than the rod;

a second milling head on the second rod end of the rod, the second milling head having a second head outer diameter;

a sacrificial anode comprising a first anode end and a second anode end, the sacrificial anode being on the central section of the rod, the sacrificial anode being softer than the surface hardness of the first milling head, the sacrificial anode being elongate between the first anode end and the second anode end, the sacrificial anode having an anode outermost diameter;

a throat area between the first shoulder and the sacrificial anode, the throat area having a throat outer diameter that is less than the anode outermost diameter; and a milling rod guide comprising the rod, the first milling head, the second milling head, and the sacrificial anode; the milling rod guide having a slenderness ratio of less than 40, wherein the slenderness ratio is defined as the overall length of the rod divided by the anode outermost diameter, and the slenderness ratio is a dimensionless number.

2. The milling rod guide system of claim 1, wherein the anode outermost diameter is within twenty percent of the first head outer diameter.

3. The milling rod guide system of claim 1, wherein the sacrificial anode defines a plurality of grooves running lengthwise between the first end and the second end of the sacrificial anode, the plurality of grooves are of a radial depth to define an anode minor diameter that is greater than the first head outer diameter and the second head outer diameter.

4. The milling rod guide system of claim 3, wherein the plurality of grooves are curved about the longitudinal axis.

5. The milling rod guide system of claim 1, further comprising a series of milling rod guides that includes the milling rod guide, wherein the tubing section is deviated from vertical up to 90 degrees.

6. The milling rod guide system of claim 1, wherein the milling rod guide is one of a plurality of milling rod guides, and the milling rod guide system further comprising a plurality of sucker rods each of which are at least twice as long as each milling rod guide of the plurality of milling rod guides, the plurality of sucker rods and the plurality of milling rod guides being interconnected in series to create a rod string.

7. The milling rod guide system of claim 6, wherein at least one sucker rod of the plurality of sucker rods is interposed between two milling rod guides of the plurality of milling rod guides.

8. The milling rod guide system of claim 6, wherein at least one milling rod guide of the plurality of milling rod guides is interposed between two sucker rods of the plurality of sucker rods.

9. The milling rod guide system of claim 6, wherein the plurality of milling rod guides are interconnected in an end-to-end arrangement, and the end-to-end arrangement is interposed between two sucker rods of the plurality of sucker rods.

10. The milling rod guide system of claim 6 further comprising:

a plurality of main tubing sections each of which are elongate along the longitudinal axis and encircle the rod string; and a plurality of hardened tubing sections each of which are elongate along the longitudinal axis and encircle the rod string, each hardened tubing section of the plurality of hardened tubing sections having a hardened inner surface that is harder than the plurality of main tubing sections, the plurality of main tubing sections and the plurality of hardened tubing sections being interconnected to provide a tubing string, at least some of the plurality of main tubing sections being interposed between two hardened tubing sections of the plurality of hardened tubing sections, at least some of the plurality of hardened tubing sections being interposed between two main tubing sections of the plurality of main tubing sections, the rod string and the tubing string being arranged such that the plurality of milling rod guides are adjacent to the plurality of hardened tubing sections, and the plurality of sucker rods are adjacent to the plurality of main tubing sections.

11. A milling rod guide system for use in a well comprising:

a rod being elongate to define a longitudinal axis, the rod having a first rod end, a second rod end, and a central section between the first rod end and the second rod end; the rod having an overall length as measured along the longitudinal axis;

a first shoulder on the rod, the first shoulder encircling the longitudinal axis, the first shoulder being between the first rod end and the central section;

a second shoulder on the rod, the second shoulder encircling the longitudinal axis, the second shoulder being between the second rod end and the central section;

a first milling head on the first rod end of the rod, the first milling head having a first head outer diameter, the first milling head having a surface hardness of at least 60 Rc at the first head outer diameter, the surface hardness of the first milling head being harder than the rod;

a second milling head on the second rod end of the rod, the second milling head having a second head outer diameter;

a sacrificial anode on the central section of the rod, the sacrificial anode being softer than the surface hardness of the first milling head, the sacrificial anode being elongate between a first anode end and a second anode end of the sacrificial anode, the sacrificial anode having an anode outermost diameter;

a milling rod guide comprising the rod, the first milling head, the second milling head, and the sacrificial anode; the milling rod guide having a slenderness ratio of less than 40, wherein the slenderness ratio is defined as the overall length of the rod divided by the anode outermost diameter, and the slenderness ratio is a dimensionless number;

a plurality of sucker rods each of which are at least twice as long as each milling rod guide of the plurality of milling rod guides, the plurality of sucker rods and the plurality of milling rod guides being interconnected in series to create a rod string;

a plurality of main tubing sections each of which are elongate along the longitudinal axis and encircle the rod string; and a plurality of hardened tubing sections each of which are elongate along the longitudinal axis and encircle the rod string, each hardened tubing section of the plurality of hardened tubing sections having a hardened inner surface that is harder than the plurality of main tubing sections, the plurality of main tubing sections and the plurality of hardened tubing sections being interconnected to provide a tubing string, at least some of the plurality of main tubing sections being interposed between two hardened tubing sections of the plurality of hardened tubing sections, at least some of the plurality of hardened tubing sections being interposed between two main tubing sections of the plurality of main tubing sections, the rod string and the tubing string being arranged such that the plurality of milling rod guides are adjacent to the plurality of hardened tubing sections, and the plurality of sucker rods are adjacent to the plurality of main tubing sections.

12. The milling rod guide system of claim 11, wherein the anode outermost diameter is within twenty percent of the first head outer diameter.

13. The milling rod guide system of claim 11, wherein the sacrificial anode defines a plurality of grooves running lengthwise between the first and second anode heads.

14. The milling rod guide system of claim 13, wherein the plurality of grooves curve about the longitudinal axis.

15. A milling rod guide method for crushing and grinding grit in a well that contains a tubing string and a rod string attached to a downhole pump, the milling rod guide method comprising:

using the downhole pump for pumping a fluid up through the tubing string;

supporting a first milling head and a second milling head on a rod that is attached to the rod string, wherein each of the first milling head and the second milling head has a hardness of at least 60 Rc;

supporting a sacrificial anode on the rod between the first milling head and the second milling head, thereby creating a first milling rod guide comprising the rod, the first milling head, the second milling head and the sacrificial anode;

positioning the first milling rod guide within the tubing string;

moving the rod string up and down within the tubing string;

moving the first milling rod guide in a reciprocating motion by moving the rod string up and down;

crushing and grinding the grit between the first milling head and an inner surface of the tubing string by moving the first milling rod guide in the reciprocating motion;

crushing and grinding the grit between the second milling head and the inner surface of the tubing string by moving the first milling rod guide in the reciprocating motion;

reducing the size of the grit from a larger particle size to a smaller particle size upon the first milling head and the second milling head crushing and grinding the grit against the inner surface of the tubing string;

providing passive galvanic protection with the sacrificial anode when a corrosion inhibitor is mechanically scraped off the inner surface of the tubing string; and flushing the grit from the well when the size of the grit is sufficiently small to be lifted and flushed with the fluid flowing up through the tubing string.

16. The milling rod guide method of claim 15, wherein reducing the size of the grit by crushing and grinding the grit against the inner surface of the tubing string occurs within a first area of the well that is less than 500 feet from the downhole pump.

17. The milling rod guide method of claim 16, further comprising using a second milling rod guide on the rod string for reducing the size of the grit by crushing and grinding the grit against the inner surface of the tubing string within a second area of the well that is more than 500 feet from the downhole pump, the second milling rod guide being spaced apart from the first milling rod guide by a plurality of sucker rods of the rod string, wherein each sucker rod of the plurality of sucker rods is longer than each of the first milling rod guide and the second milling rod guide.

18. The milling rod guide method of claim 17, wherein the first milling rod guide and the second milling rod guide are angularly displaced out of collinear alignment with each other.

* * * * *